US006293119B1

(12) United States Patent
Wenzel

(10) Patent No.: US 6,293,119 B1
(45) Date of Patent: Sep. 25, 2001

(54) ENHANCED ECONOMIZER FUNCTION IN AIR CONDITIONER EMPLOYING MULTIPLE WATER-COOLED CONDENSERS

(75) Inventor: Glenn E. Wenzel, Onalaska, WI (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 09/664,080

(22) Filed: Sep. 18, 2000

(51) Int. Cl.[7] ..... F25B 27/00; F25B 7/00

(52) U.S. Cl. ..... 62/238.6; 62/175; 62/335

(58) Field of Search ..... 62/238.6, 175, 62/333, 335, 185, 305, 271, 238.3, 94

(56) References Cited

U.S. PATENT DOCUMENTS 3,628,600 * 12/1971 McFarlan .
4,457,358 7/1984 Kriege et al. .
5,687,579 * 11/1997 Vaynberg ..... 62/335 X
5,778,696 * 7/1998 Conner ..... 62/238.6

* cited by examiner

*Primary Examiner*—Henry Bennett
*Assistant Examiner*—Chen-Wen Jiang
(74) *Attorney, Agent, or Firm*—William J. Beres; William O'Driscoll

(57) ABSTRACT

A self-contained air conditioner cools a building's air using a water-cooled economizer coil and two refrigerant evaporators. The two evaporators are provided by two separate refrigeration circuits, each having its own water-cooled condenser. A water circuit interconnecting the economizer and the two condensers is reconfigureable to selectively operate the air conditioner in a normal mode or, if conditions permit, in an energy-saving economizer mode. In the normal mode, the water circuit conveys cooling water in series through both condensers while bypassing the economizer coil. In the economizer mode, the water flows in series through the economizer and one of the condensers while bypassing the other. The refrigerant circuit whose condenser is bypassed can thus be deactivated to save energy. The economizer coil and the condenser it bypasses have generally the same flow resistance to water flow. This allows a pump to deliver cooling water through the water circuit at the same pressure and flow rate, regardless of the air conditioner's operating mode.

28 Claims, 1 Drawing Sheet

Figure 1:
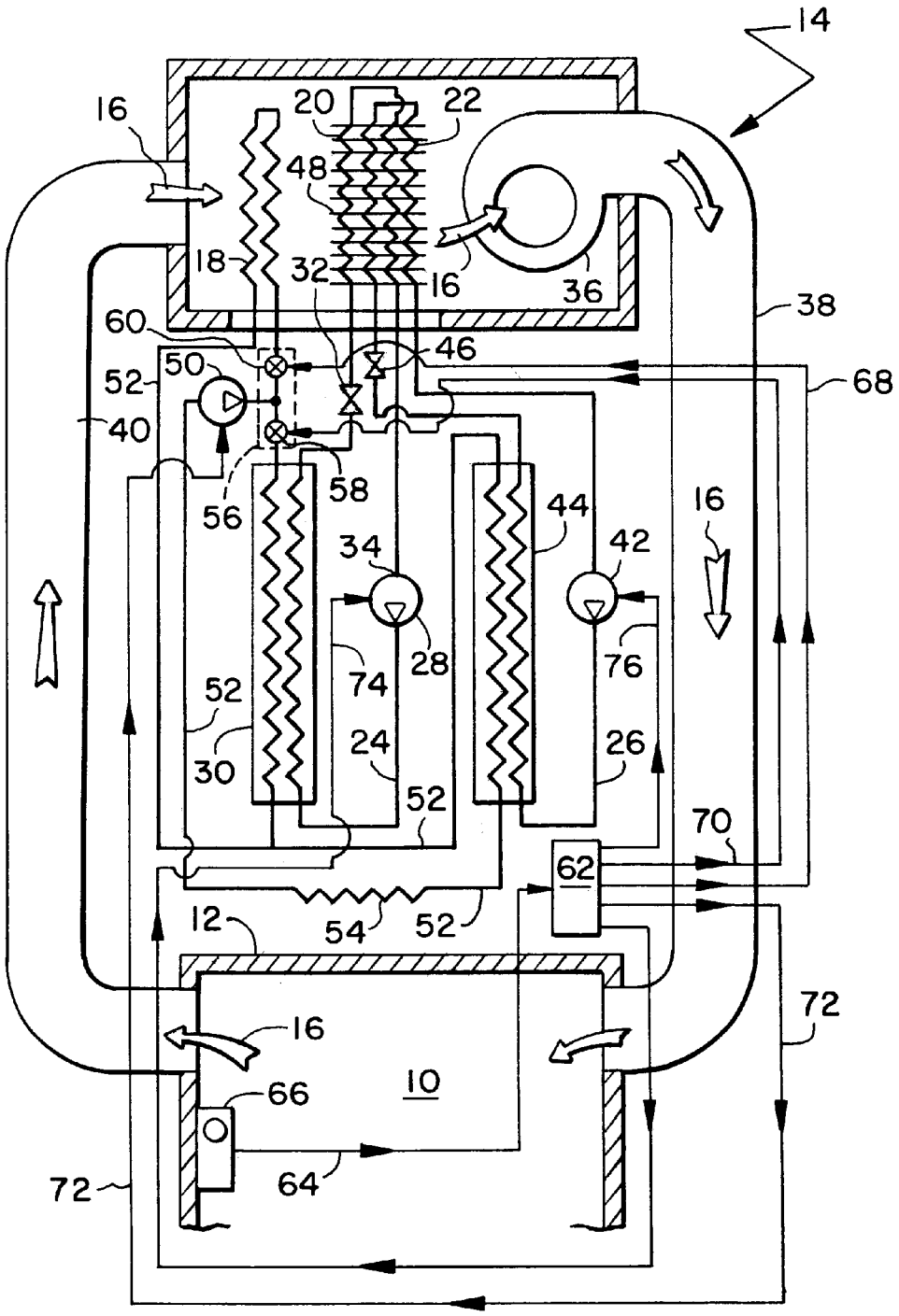

ENHANCED ECONOMIZER FUNCTION IN AIR CONDITIONER EMPLOYING MULTIPLE WATER-COOLED CONDENSERS

BACKGROUND OF THE INVENTION

1. Field of the Invention

The present invention relates to air conditioners that employ water-cooled condensers. More particularly, the present invention relates to an enhanced economizer system for air conditioners that employ multiple refrigeration circuits and multiple water-cooled condensers.

2. Description of Related Art

Self-contained air conditioners are of a type typically used in mid to large size buildings, often on a floor-by-floor basis, and in other commercial and industrial settings. Such air conditioners are often referred to as "self-contained," as they can be packaged as an indoor unit: complete with one or more refrigerant compressors, condensers and evaporators for cooling air supplied to the building. The condensers take the heat that the evaporators absorb from the air and transfer the heat to cooling water that passes through the condensers. To remove the heat from the building, a pump circulates the cooling water between the unit's indoor condensers and an outdoor cooling tower where the heat is rejected to atmosphere.

For self-contained, water-cooled air conditioners and other types of air conditioners with multiple refrigeration circuits, the cooling water typically flows in parallel through the unit's condensers. Self-contained air conditioners often include two separate refrigeration circuits, so that when the heat load within a building is low, one or more of the circuits can be turned off to save energy.

In some self-contained air conditioners, a so-called waterside economizer is employed to save additional energy. A waterside economizer is simply a heat exchanger through which cooling water is circulated to directly cool the building's air with the same water that cools the condensers. Typically, economizers are only used when the cooling demand of the building can be satisfied by less than all of the air conditioner's refrigeration circuits and/or when certain low ambient temperature conditions exist. To use an economizer under such conditions, the cooling water has historically been piped to place the economizer coil in series with any condensers (i.e., in series with respect to the flow of cooling water). The economizer coil itself is disposed in the path through which the return airstream flows through the air conditioning unit. In other words, the economizer is in same airflow path as the air conditioner's evaporators, which cool the air for the building.

By incorporating an economizer in that manner, the cooling water piped to the air conditioner passes first through the economizer and then to an operating condenser (or to an inactive condenser if none are operating). Directing the building's relatively warm return air across the water-cooled economizer coil is an energy-saving way of providing a measure of cool air. Such cooling can, in fact, be accomplished even when none of the units' refrigeration circuits are operating. Under the right conditions, an economizer can provide 50% or more of the unit's cooling capacity without any of the air conditioner's refrigeration circuits being active. Such conditions may occur when the economizer receives cooling water (e.g., from a cooling tower) at a temperature that is significantly below the building's indoor return air temperature.

Although air conditioners with economizers provide significant energy-saving advantages, problems associated with pumping the cooling water can occur. For example, during periods when a unit's economizer is not being used, the condensers alone may only subject the water pump to a pressure head of about twenty-feet of water. However, when the economizer is activated and open to the flow of cooling water, the water passes in series through both the economizer and at least one condenser. Thus, if the economizer creates a pressure drop of about ten-feet of water, the pump must overcome a total pressure head of thirty-feet of water: twenty-feet for at least one condenser plus ten-feet for the economizer.

The increased head associated with flow through the economizer in such an arrangement has a significant influence on the selection and operation of the cooling water pump. If activating and deactivating the economizer causes a significant change in pressure for the pump, the pump and its motor may need to be oversized to meet the peak discharge pressure. In some cases, a pump may require relatively expensive and/or complicated two-speed, variable speed, or other methods of control in order to meet the varying pressure conditions. Varying pressure conditions can lead to additional expense relating to the need for some form of discharge pressure control for the pump when the economizer is inactive and isolated from the flow of cooling water.

Further, the cooling water pump in not always dedicated to serving just a single self-contained air conditioning unit. But rather, such a pump typically pumps cooling water to several individual units at the same time. This subjects the pump to even greater variations in pressure, as the various units independently activate and deactivate their respective economizers to meet their individual cooling demands. Thus, this further complicates the proper selection and operation of such a pump.

The need therefore exists for a modified, more energy efficient economizer arrangement for self-contained air-conditioning systems that employ multiple water-cooled condensers.

SUMMARY OF THE INVENTION

It is an object of the present invention to provide energy savings and to reduce the expense associated with the inclusion of an economizer in a self-contained air conditioner.

It is a further object of the present invention to minimize pressure drop in the cooling medium, most often water, flowing to and through a self contained air conditioner that employs an economizer component.

It is a further object of the present invention to maintain water pressure drop within a self-contained air conditioner relatively constant irrespective of whether the air conditioners economizer is operating or is not.

It is an additional object of the present invention to reduce the pressure drop in cooling water flowing through a self-contained air conditioner which has multiple water-cooled condensers by placing such condensers in series with respect to the cooling water that flows through them and by placing the system economizer in parallel with one of the water-cooled condensers.

It is still another object of the present invention to provide an economizer arrangement for a self-contained air conditioning unit which, when activated, in effect displaces the water-cooled condenser with which it is associated with respect to water flow.

It is a further object of the present invention to provide a water-cooled self-contained air conditioner having multiple water-cooled condensers and an economizer in which the pressure drop in the cooling water therethrough is essentially unaffected by the inclusion/activation of the economizer component.

These and other objects of the present invention, which will better be appreciated when the following description of the Preferred Embodiment and attached Drawing Figures are considered, are accomplished in a self-contained air conditioner in which a waterside economizer is disposed in parallel with one of at least two condensers located in the air conditioning unit. The air conditioner employs at least two separate refrigeration circuits, each having its own water-cooled condenser. The air conditioner's waterside economizer is piped in parallel with the condenser to which water first flows. By virtue of the control of flow of water therethrough, energy savings in the context of air conditioning unit operation as well as energy savings with respect to the pump or pumps by which cooling water is pumped from the air conditioning unit are achieved while avoiding additional expense, in the form of pump head pressure control, that might otherwise exist in such systems.

DESCRIPTION OF THE DRAWING FIGURES

FIG. 1 is a schematic diagram showing a self-contained air conditioner with an economizer according to one form of the invention.

DESCRIPTION OF THE PREFERRED EMBODIMENT

To cool a comfort zone 10 within a building 12 or to meet some other cooling demand, a self-contained air conditioner 14, of FIG. 1, cools a stream of air 16 using a water-cooled economizer coil 18 and two refrigerant evaporators 20 and 22. Evaporator 20 is part of one refrigerant circuit 24, and evaporator 22 is part of a second refrigerant circuit 26. In the preferred embodiment, the two individual circuits 24 and 26 are hermetically sealed from each other. Thus, circuits 24 and 26 each have their own portion of the total amount a refrigerant in air conditioner 14.

Circuit 24 includes a refrigerant compressor 28; a water-cooled condenser 30; a flow restriction 32, such as an expansion valve; and evaporator 20. Circuit 24 operates under a conventional refrigerant cycle where compressor 28 forces refrigerant in series through condenser 30, restriction 32, evaporator 20, and back to a suction port 34 of compressor 28. Condenser 30 cools and condenses relatively hot refrigerant discharged from compressor 28. From condenser 30, the condensed refrigerant expands upon passing through restriction 32 and enters evaporator 20 preferably as a relatively cold gas. The relatively cold refrigerant in evaporator 20 cools air 16, which is forced across evaporator 20 by way of a blower 36.

After being cooled, air 16 can be used as needed. For example, a supply air duct 38 and a return air duct 40 can circulate air 16 through comfort zone 10. Fresh outside air can be mixed with recirculated indoor air to satisfy both the temperature and ventilation needs of comfort zone 10. After cooling air 16, the refrigerant in evaporator 20 returns to suction port 34 of compressor 28 to complete the cycle.

Refrigerant circuit 26, likewise includes a compressor 42, a water-cooled condenser 44, a flow restriction 46, and evaporator 22 that operates in a manner similar to that of refrigerant circuit 24. Evaporators 20 and 22 are located within the stream of air 16, and in some forms of the invention, evaporators 20 and 22 are somewhat intertwined and coupled to each other by a common set of heat transfer fins 48. Supplemental and/or alternate cooling of air 16 is accomplished by placing economizer heat exchanger 18 in the same airstream as evaporators 20 and 22, and preferably upstream of the evaporators.

To provide economizer 18 and condensers 30 and 44 with a supply of cool, heat-absorbing liquid, such as water, air conditioner 14 is associated with a pump 50 that pumps water, or some other liquid, through a liquid circuit 52. With respect to the flow of water, liquid circuit 52 connects condensers 30 and 44 in series-flow relationship to each other, and connects economizer 18 in parallel-flow relationship to condenser 30 and series-flow relationship with condenser 44. The cool water of liquid circuit 52 allows economizer 18 to cool air 16 under certain conditions and provides the cooling necessary to condense refrigerant in condensers 30 and 44 when those condensers are active. Once the water absorbs heat in economizer 18, condensers 30 and/or 44, liquid circuit 52 circulates the warmed water through a conventional cooling tower 54, which rejects the heat to atmosphere.

To cool air 16 under various indoor and outdoor air conditions, a valve system 56 reconfigures liquid circuit 52 to selectively operate air conditioner 14 in a normal mode and an energy-conserving economizer mode.

In the normal mode, valve 58 of valve system 56 opens, and a valve 60 of system 56 closes. Valve 58 being open allows pump S0 to circulate water in series through condensers 30 and 44. Valve 60 being closed effectively deactivates economizer 18, as the water simply bypasses economizer 18 by flowing through condenser 30 instead. Meanwhile, compressors 28 and 42 are both energized to render refrigerant circuits 24 and 26 fully operational to cool air 16 with evaporators 20 and 22. This normal mode of operation is preferably for meeting generally higher cooling demands and/or when the outdoor air conditions (i.e., temperature and relative humidity) significantly limit the cooling tower's ability to cool the water below the temperature of air 16.

Under milder operating conditions, valve 60 opens and valve 58 closes to operate air conditioner 14 in the economizer mode. In this mode, valve 60 being open directs water in series through economizer 18 and condenser 44. Valve 58 being closed effectively disables condenser 30, as the water passing through economizer 18 now bypasses condenser 30. With condenser 30 disabled, refrigerant circuit 24 is preferably deactivated by de-energizing or at least unloading compressor 28. Thus, only evaporator 22 and economizer 18 actively cool air 16, while refrigerant circuit 24 is left inactive to save energy.

Under even milder operating conditions, such as when the outdoor air temperature and/or relative humidity is especially low, refrigerant circuits 24 and 26 can both be deactivated by de-energizing or unloading their respective compressors 28 and 42. With valve 60 open and valve 58 closed, pump 50 can continue pumping water in series through economizer 18 and condenser 44 to cool air 16 with economizer 18 alone doing all the cooling. Thus, operating air conditioner 14 in such a manner can achieve even more energy savings.

When switching between normal and economizer modes, pump 50 preferably operates under generally the same pumping conditions, e.g., generally the same water pressure and flow rate, and thus generally the same power consumption. This allows the use of a single speed electrical motor driving pump 50 at or near its rated capacity, rather than using an oversized pump to handle an occasional peak pressure.

To this end, the total flow resistance of liquid circuit 52 is held generally constant by having the individual water flow resistance of economizer 18 and condenser 30 be substantially equal (i.e., within 20 percent of each other. Thus, the total flow resistance of liquid circuit 52 (with respect to just economizer 18 and condensers 30 and 44) equals the water flow resistance of condenser 44 plus the resistance of either condenser 30 (in the normal mode) or economizer 18 (in the economizer mode). With the water flow resistance of economizer 18 and condenser 30 being generally the same, the total flow resistance of circuit 52, thus, remains generally the same, regardless of the operating mode.

It should be appreciated by those skilled in the art that valve system 56, including valves 58 and 60, is schematically illustrated to encompass individual valves as well as a single directional valve providing substantially the same function of closing one path and opening another. Valve system 56 not only encompasses valves having binary positions of fully open and fully closed, but also encompasses valves of variable opening, so that valve system 56 can proportion water flow to economizer 18 and condenser 30 in a modulating manner. In other words, in some cases, valve system 56 may direct 40 percent of the water flow through economizer 18 and direct 60 percent of the flow through condenser 30, with 100 percent of the flow still passing through condenser 44.

Although the opening and closing of valve system 56 can be done manually, it is preferably performed automatically. For example, in some forms of the invention, a control 62 responsive to an input 64 from one or more sensors 66 (e.g., temperature sensor) provides outputs 68, 70, 72, 74, and 76 to control the operation of valve 60, valve 58, pump 50, compressor 28, and compressor 42, respectively. Control 62 is schematically illustrated to encompass a wide variety of controls familiar to those skilled in the art. Examples of control 62 include, but are not limited to, personal computers, microcomputers, dedicated electrical circuits having analog and/or digital components, programmable logic controllers, and various combinations thereof.

Although the invention is described with reference to a preferred embodiment, it should be appreciated by those skilled in the art that other variations are well within the scope of the invention. Therefore, the scope of the invention is to be determined by reference to the claims, which follow.

I claim:

1. An air conditioner that absorbs heat from air and rejects heat to a liquid, comprising:

a first condenser adapted to eject heat to said liquid;

a second condenser adapted to eject heat to said liquid;

an economizer heat exchanger adapted to transfer heat from said air to said liquid; and a liquid circuit interconnecting and adapted to convey said liquid through said first condenser, said second condenser, and said economizer heat exchanger, wherein said first and second condensers are connected in series-flow relationship with respect to said liquid, said economizer heat exchanger and said second condenser are connected in series-flow relationship with respect to said liquid, and said economizer heat exchanger and said first condenser are connected in parallel-flow relationship with respect to said liquid.

2. The air conditioner of claim 1, further comprising a valve system connected to said liquid circuit and being selectively configurable in a normal mode and an economizer mode, wherein said valve system in said normal mode directs more of said liquid in series through said first condenser and said second condenser than through said economizer heat exchanger, and said valve system in said economizer mode directs more of said liquid in series through said second condenser and said economizer heat exchanger than through said first condenser.

3. The air conditioner of claim 1, wherein said first condenser is part of a first refrigerant circuit and said second condenser is part of a second refrigerant circuit with said first refrigerant circuit being hermetically sealed from said second refrigerant circuit.

4. The air conditioner of claim 1, wherein said air conditioner is operable in a normal mode and an economizer mode, wherein a refrigerant flows through said first condenser at a higher flow rate in said normal mode than in said economizer mode.

5. The air conditioner of claim 1, wherein said air conditioner is operable in a normal mode and an economizer mode with substantially all of said liquid bypassing said economizer heat exchanger and passing in series through said first condenser and said second condenser in said normal mode, and substantially all of said liquid bypassing said first condenser and passing in series through said economizer heat exchanger and said second condenser in said economizer mode.

6. The air conditioner of claim 1, wherein said liquid circuit includes a valve system that modulates proportions of said liquid being directed to said economizer heat exchanger and said first condenser.

7. The air conditioner of claim 1, wherein said first condenser and said economizer heat exchanger provide substantially equal flow resistance to said liquid.

8. The air conditioner of claim 1, wherein said air conditioner is operable in a normal mode and an economizer mode and further comprising a liquid pump that pumps said liquid through said liquid circuit, wherein said liquid pump consumes a substantially equal amount of power in said normal mode as in said economizer mode.

9. An air conditioner that absorbs heat from air and rejects heat to a liquid, comprising:

a first condenser adapted to eject heat to said liquid;

a second condenser adapted to eject heat to said liquid;

an economizer heat exchanger adapted to transfer heat from said air to said liquid; and a liquid circuit in fluid communication with said first condenser, said second condenser and said economizer heat exchanger with said liquid circuit being selectively configurable in a normal mode and an economizer mode, wherein said liquid circuit in said normal mode directs more of said liquid in series through said first condenser and said second condenser than through said economizer heat exchanger, and said liquid circuit in said economizer mode directs more of said liquid in series through said second condenser and said economizer heat exchanger than through said first condenser when said liquid circuit is in said economizer mode.

10. The air conditioner of claim 9, wherein said first condenser is part of a first refrigerant circuit and said second condenser is part of a second refrigerant circuit with said first refrigerant circuit being hermetically sealed from said second refrigerant circuit.

11. The air conditioner of claim 10, wherein said first refrigerant circuit includes a first evaporator adapted to absorb heat from said air, and said second refrigerant circuit includes a second evaporator adapted to absorb heat from said air.

12. The air conditioner of claim 11, wherein said first evaporator and said second evaporator share a plurality of heat transfer fins.

13. The air conditioner of claim 10, further comprising a first compressor associated with said first refrigerant circuit and being active in said normal mode but inactive in said economizer mode, and a second compressor associated with said second refrigerant circuit and being active in said normal mode and in said economizer mode.

14. The air conditioner of claim 11, wherein said economizer heat exchanger is upstream of said first evaporator and said second evaporator with respect to a flow direction of said air.

15. The air conditioner of claim 9, wherein substantially all of said liquid bypasses said economizer heat exchanger and passes in series through said first condenser and said second condenser in said normal mode, and substantially all of said liquid bypasses said first condenser and passes in series through said economizer heat exchanger and said second condenser in said economizer mode.

16. The air conditioner of claim 9, wherein said liquid circuit includes a valve system that modulates proportions of said liquid being directed to said economizer heat exchanger and said first condenser.

17. The air conditioner of claim 9, wherein said first condenser and said economizer heat exchanger provide substantially equal flow resistance to said liquid.

18. The air conditioner of claim 9, further comprising a liquid pump that pumps said liquid through said liquid circuit, wherein said liquid pump consumes a substantially equal amount of power in said normal mode as in said economizer mode.

19. An air conditioner that uses a refrigerant in transferring heat from air to a liquid and being selectively operable in a normal mode and an economizer mode, comprising:

a first refrigerant circuit including a first condenser adapted to transfer heat from a first portion of said refrigerant to said liquid, a first evaporator adapted to transfer heat from said air to said first portion of said refrigerant, and a first compressor adapted to compress and force said first portion of said refrigerant through said first condenser and said first evaporator, wherein said refrigerant flows through said first condenser at a higher flow rate in said normal mode than in said economizer mode;

a second refrigerant circuit including a second condenser adapted to transfer heat from a second portion of said refrigerant to said liquid, a second evaporator adapted to transfer heat from said air to said second portion of said refrigerant, and a second compressor adapted to compress and force said second portion of said refrigerant through said second condenser and said second evaporator, said first refrigerant circuit being hermetically sealed from said second refrigerant circuit such that said first portion of said refrigerant remains separate from said second portion of said refrigerant;

an economizer heat exchanger adapted to transfer heat from said air to said liquid; and a liquid circuit coupled to said first condenser, said second condenser and said economizer heat exchanger, and being selectively reconfigureable, wherein said liquid circuit in a normal mode directs more of said liquid in series through said first condenser and said second condenser than through said economizer heat exchanger, and said liquid circuit in an second configuration directs more of said liquid in series through said second condenser and said economizer heat exchanger than through said first condenser when said liquid circuit is in said economizer mode.

20. The air conditioner of claim 19, wherein substantially all of said liquid bypasses said economizer heat exchanger and passes in series through said first condenser and said second condenser in said normal mode, and substantially all of said liquid bypasses said first condenser and passes in series through said economizer heat exchanger and said second condenser in said economizer mode.

21. The air conditioner of claim 19, wherein said liquid circuit includes a valve system that in said economizer mode modulates proportions of said liquid being directed to said economizer heat exchanger and said first condenser.

22. The air conditioner of claim 19, wherein said first condenser and said economizer heat exchanger provide substantially equal flow resistance to said liquid.

23. The air conditioner of claim 19, further comprising a liquid pump that pumps said liquid through said liquid circuit, wherein said liquid pump consumes a substantially equal amount of power in said normal mode as in said economizer mode.

24. The air conditioner of claim 19, wherein said economizer heat exchanger is upstream of said first evaporator and said second evaporator with respect to a flow direction of said air.

25. The air conditioner of claim 19, further comprising a plurality of heat transfer fins that mechanically couple said first evaporator to said second evaporator.

26. A method of cooling air using an air conditioner selectively operable in a normal mode and an economizer mode, comprising:

conveying a heat absorbing liquid in series through a first condenser and a second condenser in said normal mode;

conveying said heat absorbing liquid in series through an economizer heat exchanger and said second condenser while bypassing said first condenser in said economizer mode; and conveying said air in series across said economizer heat exchanger, a first evaporator associated with said first condenser, and a second evaporator associated with said second condenser.

27. The method of claim 26, further comprising:

creating a first liquid pressure differential across said first condenser upon conveying said heat absorbing liquid therethrough during said normal mode; and creating a second liquid pressure differential across said economizer heat exchanger upon conveying said heat absorbing liquid therethrough during said economizer mode, wherein said first liquid pressure differential is substantially equal to said second pressure differential.

28. The method of claim 26, further comprising:

conveying a first portion of a refrigerant through said first condenser at a flow rate that is less during said economizer mode than during said normal mode; and conveying a second portion of said refrigerant through said second condenser at a flow rate that is substantially the same during said economizer mode as during said normal mode.

* * * * *